US005960800A

United States Patent [19]

Yasuda

[11] Patent Number: 5,960,800

[45] Date of Patent: Oct. 5, 1999

[54] HAIR CLIP

[75] Inventor: Masahiro Yasuda, Osaka, Japan

[73] Assignee: Kabushiki Kaisha Yasuda Corporation, Osaka, Japan

[21] Appl. No.: 09/184,969

[22] Filed: Nov. 3, 1998

[30] Foreign Application Priority Data

Dec. 16, 1997 [JP] Japan ..... 9-345989

[51] Int. Cl.[6] ..... A45D 8/22; A45D 8/28

[52] U.S. Cl. ..... 132/278; 132/279

[58] Field of Search ..... 132/278, 275, 132/267, 277, 279; D28/39, 40, 41, 42, 43

[56] References Cited

U.S. PATENT DOCUMENTS 2,921,589 1/1960 Blomme ..... 132/279
4,919,155 4/1990 Yasuda ..... 132/278
5,259,405 11/1993 Hua-Chou ..... 132/279
5,445,170 8/1995 Yasuda ..... 132/279
5,596,998 1/1997 Yasuda ..... 132/275
5,682,909 11/1997 Yasuda ..... 132/279

*Primary Examiner*—Gene Mancene
*Assistant Examiner*—Pedro Philogene
*Attorney, Agent, or Firm*—Armstrong, Westerman Hattori, McLeland & Naughton

[57] ABSTRACT

A hair retainer is pivoted to one end portion of an ornamental cover. At a top portion of the hair retainer, a releasing mechanism is provided to unlatch engaging arms provided at the other end portion of the ornamental cover from a pair of engaging portions provided at a movable end of the hair retainer. The releasing mechanism is a releasing member that extends from the hair retainer to be disposed between the pair of engaging portions, and that opposes a top portion of the engaging arms in a latched state. The releasing member unlatches the engaging arms latched to the engaging portions by drawing the engaging arms together when the releasing member is pushed towards the engaging arms.

6 Claims, 6 Drawing Sheets

HAIR CLIP

BACKGROUND OF THE INVENTION

1. Field of the Invention

The present invention relates to a hair clip and, more particularly, to an ornamental hair clip for retaining hair by and between two members by a spring force.

2. Description of the Related Art

There are many kinds of hair clips known in the art, as disclosed for example in Japanese Unexamined Utility Model Publication Nos. S45(1970)-3321, S50(1975)-47698, S50(1975)-151495, S57(1982)-55403 and S61(1986)-174504. These prior art hair clips generally include an ornamental cover, a base plate fixed to the ornamental cover, a downwardly curved and band-shaped spring board which has both of its ends fixed to the base plate, and a band-shaped hair retainer operably disposed outside the spring board. The hair retainer has a fixed end pivoted to a pair of brackets protruding from one end of the base plate, and also has a movable end with an engaging part which is releasably latched to a pair of hooks provided at the other end of the base plate.

These prior art hair clips retain hair by and between the spring board and the hair retainer, with the engaging part thereof being held in place by the hooks. When the hairs are to be released from the clip, the movable end of the hair retainer is unlatched from the base plate by pressing ledges towards each other, which ledges are integral with the hooks and protrude from the base plate.

Thus, the unlatching operation of those conventional hair clips is done by gripping the pair of ledges underneath the ornamental cover. However, the insertion of the user's fingers underneath the ornamental cover is not easy because the cover is in close contact with the user's head. Especially when the ornamental cover is relatively large, the hair release becomes more difficult because of a large distance between the periphery of the cover and the ledges.

In order to resolve this problem, the present applicant previously proposed a novel type of hair clip as disclosed in the U.S. Pat. No. 4,919,155. This prior hair clip includes a release mechanism which causes the hooking arms to close each other to unlatch the hair retainer when the hair retainer is pressed towards the base plate.

In detail, the hair clip in accordance with the preceding proposal includes a base plate attached to an ornamental cover and a pair of brackets at one end and a pair of ledges at the other end, and a hair retainer rotatably connected to the brackets at its fixed end. The hair retainer has an engaging portion at its other movable end. The engaging portion includes a central dented part and a pair of arched bridge parts at opposite sides of the dented part. The hair clip further includes a ring placed between the central dented part and the arched bridge parts. The ring has a central opening for allowing the leg portions of the hooking arms to fit in when they overlap with each other for unlatching.

In use, this hair clip having the ring as a releaser can be removed from the user's hairs, for example, by pressing one end of the ornamental cover towards the user's head and then releasing the pressing state.

When releasing the hair clip, the user no longer needs to insert his or her fingers underneath the ornamental cover, contrary to the various prior art hair retainers, so as to operate the ledges. Instead of doing so, the user who wants to remove the hair clip may simply press an end of the ornamental cover. Thus, the hair clip can be removed very easily even if its ornamental cover is considerably large.

The hair clip according to the preceding proposal has, however, proved somewhat problematic from the following points of view.

The ring serving as the hair releaser has a central opening into which the overlapped pair of hooking arms are forcibly inserted. Therefore, the ring must be of a tenacity sufficient to withstand a strong outward radial force which the forcibly fitted arms impart to the ring.

Since the arms are strongly urged against the inner peripheral wall of the central opening of the ring, the ring must also be highly resistant to abrasion. Further, the ring must not cause an intensive friction that will hinder the arms from smoothly fitting in the central opening. Thus, the ring has to be made of a stiff material meeting all of the mentioned requirements, with the inner periphery of its central opening being nevertheless machined to have a less frictional finished surface. This raises the manufacture cost of such a ring.

It is noted that the ring, which is disposed between the central dented part and the opposite bridge parts both formed at the movable end of the hair retainer, is capable of moving up and down. Therefore, a means for preventing the ring from slipping off is necessary. This protecting means may comprise a pair of parallel guide posts extending from opposite longitudinal ends of the dented part. Correspondingly, slots are formed on the periphery of the ring so as to engage with the respective guide posts.

Such a protecting means will, however, complicate the structure of the ring and hair retainer. The manufacture thereof, in particular, the work for mounting the ring to the retainer, is not made easy but is required to be considerably intricate so as to raise production cost.

Other hooking tip ends of the pair of overlapping arms are forced to rub the inner periphery of the central opening of the ring whenever the retainer is released. Thus, the tip ends are likely to be worn out soon so that the hair clip as a whole can become less durable.

SUMMARY OF THE INVENTION

An object of the present invention which was made to resolve the aforementioned and other problems is, therefore, to provide a hair clip which is readily releasable from the hair of a user, is simple in structure, is easy to manufacture and assemble, and is improved in durability.

According to the present invention, the hair clip includes an ornamental cover having a pair of overlapped engaging arms at one end portion of the ornamental cover and a bracket at the other end portion of the ornamental cover, a hair retainer having a first end portion pivoted to the bracket and a second end portion provided with a pair of spaced apart engaging portions to be latched to the pair of engaging arms, and a releaser for unlatching the pair of engaging arms from the pair of engaging portions.

The releaser includes a releasing member which extends from the hair retainer and is disposed between the pair of engaging portions. The releasing member is opposed to top end portions of the pair of engaging arms when the pair of engaging arms are latched to the pair of engaging portions, and draws the pair of engaging arms so as to further overlap each other when the releasing member is pressed against the pair of engaging arms, thereby unlatching the pair of engaging arms from the pair of engaging portions.

Accordingly, it is possible to detach the hair clip from its attached state to a user's head by a simple operation of pushing one end portion of the ornamental cover towards the user's head and then to release the pushing operation. Additionally, while simple in structure, a latching operation and an unlatching operation can be surely performed.

At least a portion of the releasing member that abuts a top portion of the pair of engaging arms is preferably formed to have a substantially U-like cross-section. Thereby, the number of parts can be reduced and the structure becomes simple.

The hair retainer preferably has at the second end portion an actuating end portion bent in a direction away from the ornamental cover. Thereby, the latching operation and the unlatching operation can be facilitated.

It is preferable that the hair retainer has a stopper extending sideways from the first end portion and the bracket has a shoulder formed at a top portion of the bracket, and the stopper abuts the shoulder to restrain further rotation of the hair retainer towards a closing direction in a state that the hair retainer is opened at predetermined angle relative to the ornamental cover, and thereby the hair retainer is urged to spring open owing to its resilient force in the latched state. In this case, it is not necessary to provide a spring board or the like between the ornamental cover and the hair retainer to surely perform the unlatching operation, resulting in the reduction of the number of parts and a simple structure.

It is preferable that the hair retainer has an actuating end portion bent in a direction away from the ornamental cover, and the releasing member is pushed by the pair of engaging arms to be disposed downwardly from a plane which includes the actuating end portion when the pair of engaging arms are latched to the pair of engaging portions, while the releasing member is disposed upwardly from the plane when the engaging portions are unlatched from the pair of engaging arms. In this case, the latching operation and the unlatching operation can be performed only by a pushing operation of one end portion of the ornamental cover towards the user's head and releasing the pushing operation.

The pair of engaging arms and the bracket are preferably separated from each other and fixed to the ornamental cover separately. In this case, it is possible to omit a conventional elongate base plate that extends generally the entire length of the ornamental cover at its back surface and to utilize the ornamental cover as the base plate, resulting in a saving of the material cost.

The present invention will be more fully described and better understood from the following description of the preferred embodiments, taken with the appended drawings.

DETAILED DESCRIPTION OF THE PREFERRED EMBODIMENTS

Figure 1:
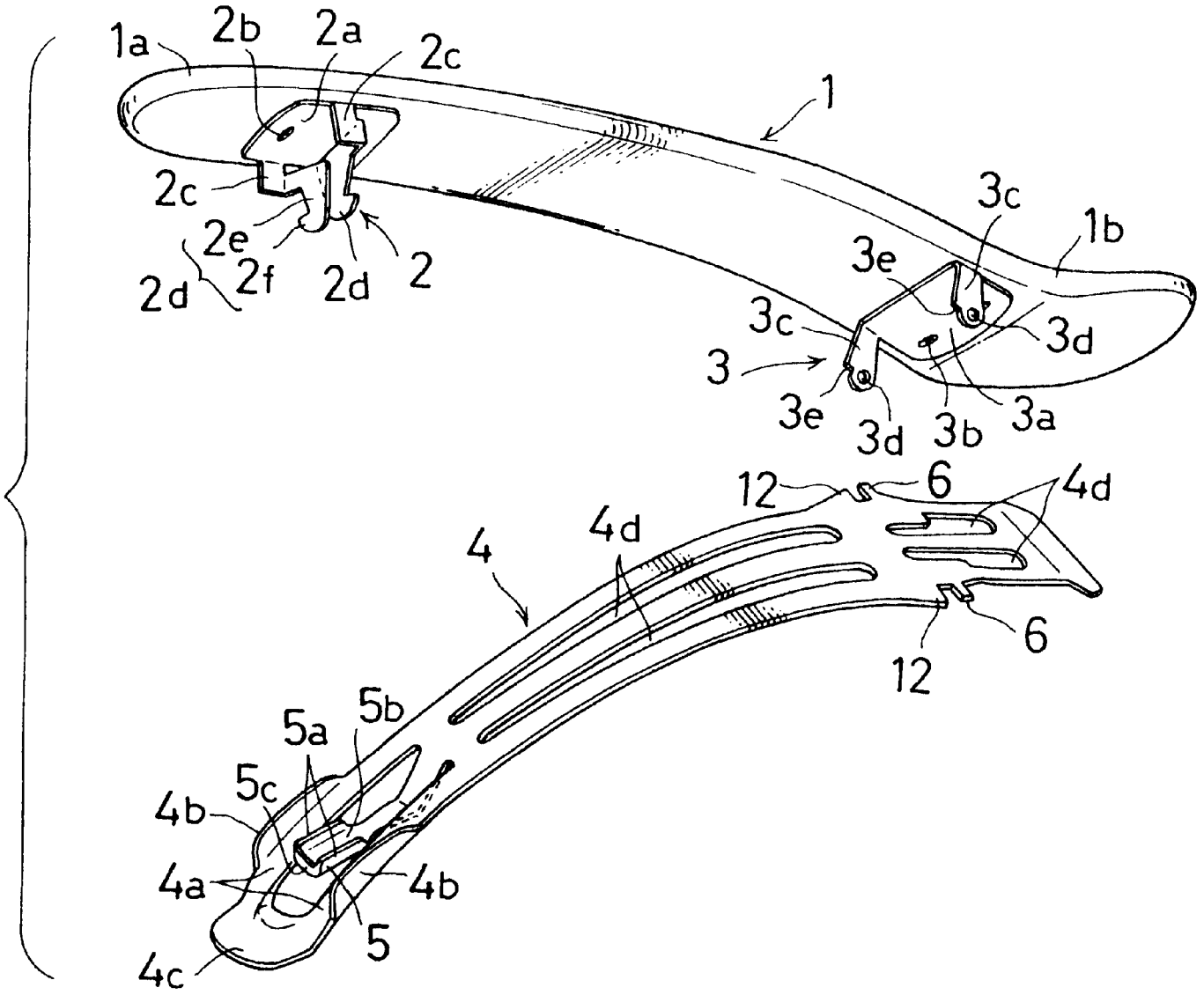
FIG. 1 is a perspective view showing an ornamental cover and a hair retainer which constitute the hair clip in one embodiment of the present invention in a disassembled state.

Preferred embodiments of the present invention will now be described, in detail, with reference to the accompanying drawings.

A hair clip in the illustrated embodiment includes an ornamental cover 1, an engaging member 2 attached to a back surface of the cover at one end portion, a bracket 3 attached to the other end portion thereof, a hair retainer 4 whose base end portion is pivoted on the bracket 3, and a releasing member 5 formed on the hair retainer 4.

The ornamental cover 1 is a molded article made of a hard synthetic resin formed into a band-shaped plate as shown in FIG. 1.

At one end portion 1*a* of the back surface of the ornamental cover 1, the engaging member 2 is directly attached. At the other end portion 1*b* thereof, the bracket 3 is directly attached. The engaging member 2 and the bracket 3 are each made of a metal. Since these members, the engaging member 2 and the bracket 3, are separately formed and separately fixed to the ornamental cover 1, it is possible to omit a conventional elongate base plate extending generally the entire length of the ornamental cover 1 and to utilize the ornamental cover as a base plate. Therefore, it is advantageous in saving the cost of materials. However, such a conventional elongate base plate having both the engaging member and the bracket may be employed instead of the above mentioned separate members. Each of the engaging member 2 and the bracket 3 is fixed to the ornamental cover 1 by punched holes 2*b*, 3*b* formed at base portions 2*a*, 3*a*.

As shown in FIG. 1, the engaging member 2 has a pair of ledges 2*c*, 2*c* extending downward from opposite lateral sides of the base portion 2*a* and a pair of engaging arms 2*d*, 2*d*of an L-shape extending from the ledges and disposed in an overlapped state. The engaging arms 2*d*, 2*d* have vertical legs 2*e*, 2*e* overlapping each other, and are normally slightly opened towards their lower ends corresponding to an opening of the ledges 2*c*, 2*c*. A lower end of each engaging arm 2*d* is rounded, and an engaging hook 2*f* is provided at an outer edge portion of each engaging arm 2*d*.

As shown in FIG. 1, the bracket 3 has a pair of ledges 3*c* extending downward from opposite lateral sides of the base portion 3*a*. A pivot receiving aperture 3*d* is formed at a lower portion of each ledge 3*c*, and a shoulder 3*e* is formed at a lower inside edge of each ledge 3*c*.

Figure 2:
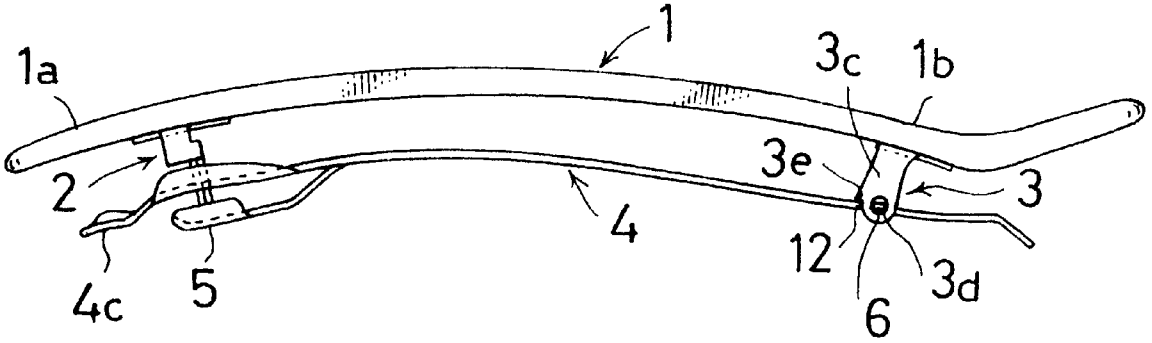
FIG. 2 is a side view showing the hair clip in a latched state.

As shown in FIG. 1, the hair retainer 4 includes a band-shaped elastic metal sheet with its longitudinal center being slightly curved upwards. At a left end of the hair retainer 4, an elongate U-shaped cutout is provided along its longitudinal direction. Parallel band-shaped portions beside the U-shaped cutout include engaging portions 4*a*, 4*a* while a remaining portion positioned between the engaging portions includes the releasing member 5. At outer edge of each engaging portion 4*a*, an upwardly extending side edge portion 4*b* is integrally provided. The side edge portions 4*b* contribute to improve the strength of the engaging portion 4*a*. A portion connecting top end portions of the engaging portions 4*a* includs an actuating end portion 4*c*. The actuating end portion 4*c* is downwardly bent to position below the engaging portions 4*a*, 4*a*, as shown in FIG. 2, for example. The actuating end portion 4*c* facilitates an operation for latching the engaging portions 4*a* with the engaging arms 2*d*.

Figure 3:
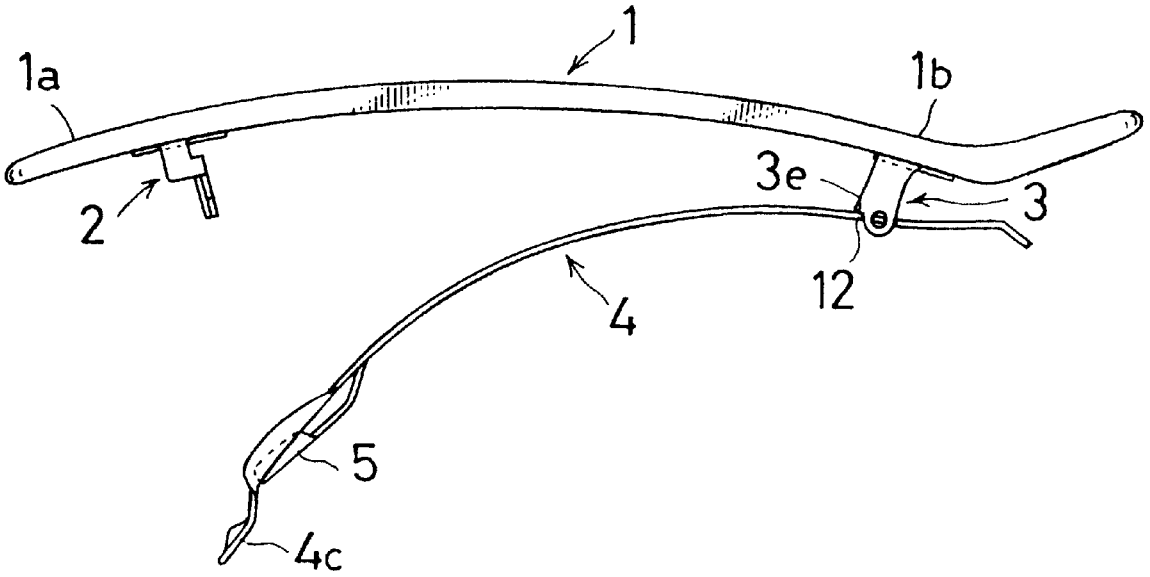
FIG. 3 is a side view showing the hair clip in an unlatched state.

As will be described below, the releasing member 5 serves to release the latched state of the engaging arms 2*d*, 2*d* relative to the engaging portions 4*a*, 4*a* by moving the engaging arms 2*d*, 2*d* so as to draw them together. The releasing member 5 can be easily manufactured by pressing the remaining portion surrounded by the U-shaped cutout, for example. As best shown in FIGS. 1 and 3, the releasing member 5 is bent downward from its basal end portion, or the right end portion, and is then bent upward so that the movable end portion, or the left end portion, is normally positioned between the engaging portions 4*a*, 4*a*. The movable end portion is formed to have a substantially U-shaped cross-section by opposite side walls 5*a*, 5*a* and a bottom wall 5*b* connecting the side walls 5*a*, 5*a* Since the releasing member 5 needs to have enough strength, in this embodiment, it has an end wall 5*c* that connects the side walls 5*a*, 5*a* and the bottom wall 5*b*.

The hair retainer 4 has a pair of small pivots 6, 6 at its end portion, which integrally protrude outward from opposite sides, and a pair of stoppers 12, 12, which also integrally protrude outward and which are longitudinally spaced apart from the small pivots 6, 6 toward the center of the hair retainer.

The hair retainer 4 has slots 4*d* extending in the longitudinal direction at an intermediate portion and a proximate right end portion thereof, respectively.

As shown in FIGS. 2 and 3, the right end portion of the hair retainer 4 is disposed between the ledges 3*c*, 3*c* of the bracket 3 with the small pivots 6, 6 fitted within the pivot receiving apertures 3*d*, 3*d*. Thus, the hair retainer 4 is rotatably connected to the bracket 3, or to the ornamental cover 1. In this pivotal state, as shown in FIG. 3, when the hair retainer 4 is operated to close until the engaging portions 4*a*, 4*a* are disposed to have a certain distance from the engaging arms 2*d*, 2*d* of the engaging member 2, the stoppers 12, 12 of the hair retainer 4 abut the shoulders 3*e*, 3*e* of the bracket 3, thereby the hair retainer 4 is restrained from further closing.

The hair retainer 4 is closed and opened about its pivotal point at the right end portion thereof and can clip a user's hair between the ornamental cover 1 and the hair retainer 4.

Now, the latching operation and the unlatching operation of the hair clip will be described below.

When the hair retainer 4 is operated to close from the state shown in FIG. 3, the stoppers 12, 12 abut the shoulders 3*e*, 3*e* of the bracket 3 as described above.

However, since the hair retainer 4 is formed from a resilient metal sheet, when the movable end of the hair retainer 4 is further pushed towards the ornamental cover 1 against its resilient force, the hair retainer 4 flexes until the engaging portions 4*a*, 4*a* abut the lower portions of the engaging arms 2*d*, 2*d*. By further pressing the actuating end portion 4*c*, the closing operation of the hair retainer 4 can easily be done.

Figure 4:
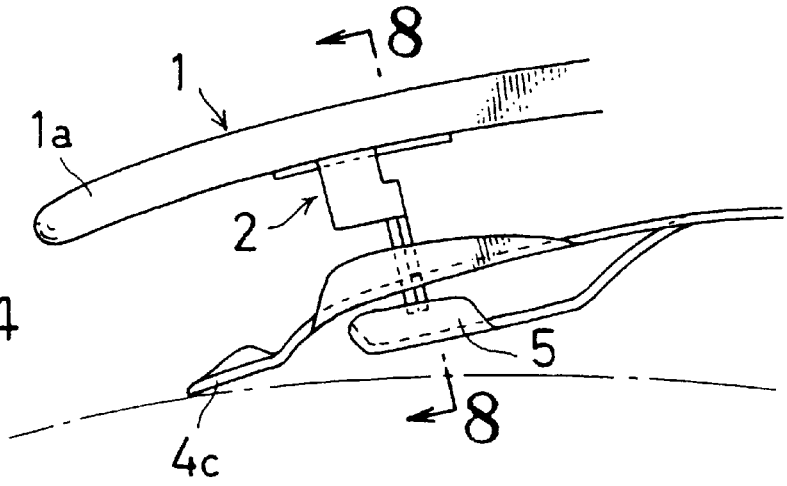
FIG. 4 is an enlarged side view around an engaging portion in its latching process.
Figure 8:
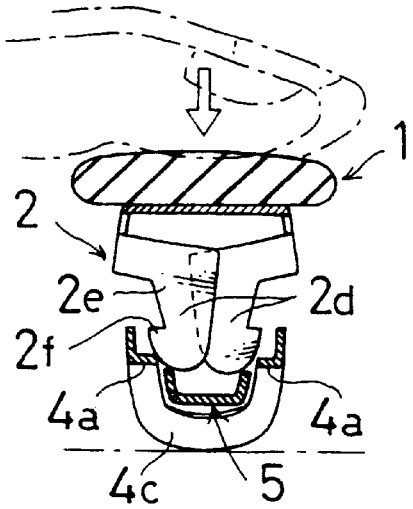
FIG. 8 is a cross-sectional view taken along the line 8—8 of FIG. 4.

When the movable end of the hair retainer 4, or the actuating end portion 4*c*, is further pushed toward the ornamental cover 1, inner edges of the engaging portions 4*a*, 4*a* of the hair retainer 4 are led towards base ends of the vertical legs 2*e*, 2*e* while the engaging portions slide along the lower rounded portions of the vertical legs 2*e*, 2*e*, as shown in FIGS. 4 and 8. As a result, the vertical legs 2*e*, 2*e* further overlap each other.

Figure 5:
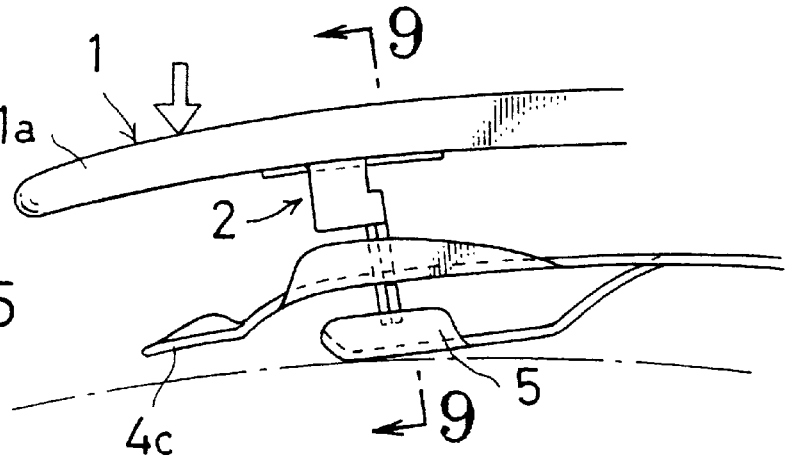
FIG. 5 is an enlarged side view around an engaging portion in the latched state.
Figure 9:
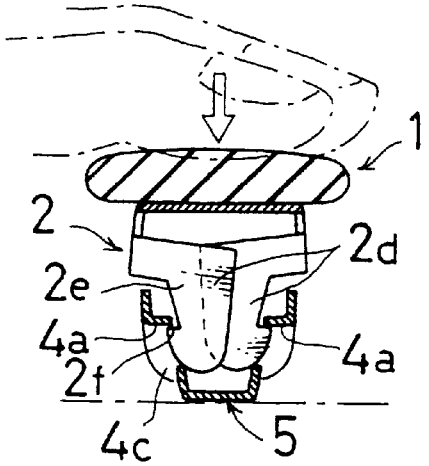
FIG. 9 is a cross-sectional view taken along the line 9—9 of FIG. 5.

And when the engaging portions 4*a*, 4*a* pass the hooks 2*f*, 2*f*, the engaging arms 2*d*, 2*d* spring outwardly open respectively due to the resilient force, whereby the engaging portions 4*a*, 4*a* are latched by the hooks 2*f*, 2*f* as shown in FIGS. 5 and 9. In this latched state, the releasing member 5 abuts the lower portion of the engaging arms 2*d*, 2*d* as shown in FIGS. 2, 5 and 9, and is positioned below a plane including the actuating end portion 4*c*, as best shown in FIG. 9.

The releasing of the latched state will be effected by causing the vertical legs 2*e*, 2*e* of engaging arms 2*d*, 2*d* to again further overlap each other. Details of such unlatching operation in this embodiment are described as follows.

At first, the releasing member 5 of the hair retainer 4 is moved towards the ornamental cover 1. Although this operation can be done by pinching the releasing member 5 and the ornamental cover 1 with one's fingers, it also can be done by pushing the ornamental cover 1 towards the user's head when the hair clip is attached to the user's head. This is because the releasing member 5 is located below the plane including the actuating end portion 4*c* in the latched state as described above.

Figure 6:
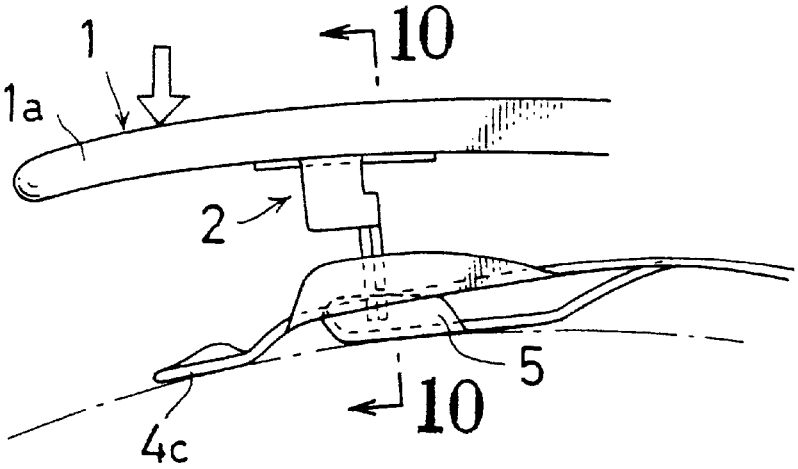
FIG. 6 is an enlarged side view around an engaging portion in its unlatching process.
Figure 10:
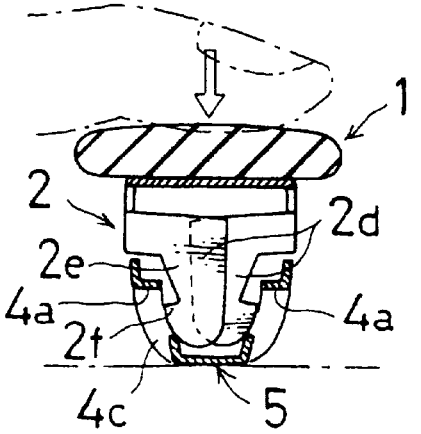
FIG. 10 is a cross-sectional view taken along the line 10—10 of FIG. 6.

When the releasing member 5 is moved relatively towards the ornamental cover 1 as described above, the releasing member 5 which has a U-shape cross-section, contacts the rounded portion of the engaging arms 2*d*, 2*d*, causing the vertical legs 2*e*, 2*e* of the engaging arms 2*d*, 2*d* to further overlap each other as shown in FIGS. 6 and 10. The arms 2*d*, 2*d* and are fitted in and held by the releasing member 5, and thus the hooks 2*f*, 2*f* of the engaging arms 2*d*, 2*d* are released from the engaging portions 4*a*, 4*a*.

Figure 7:
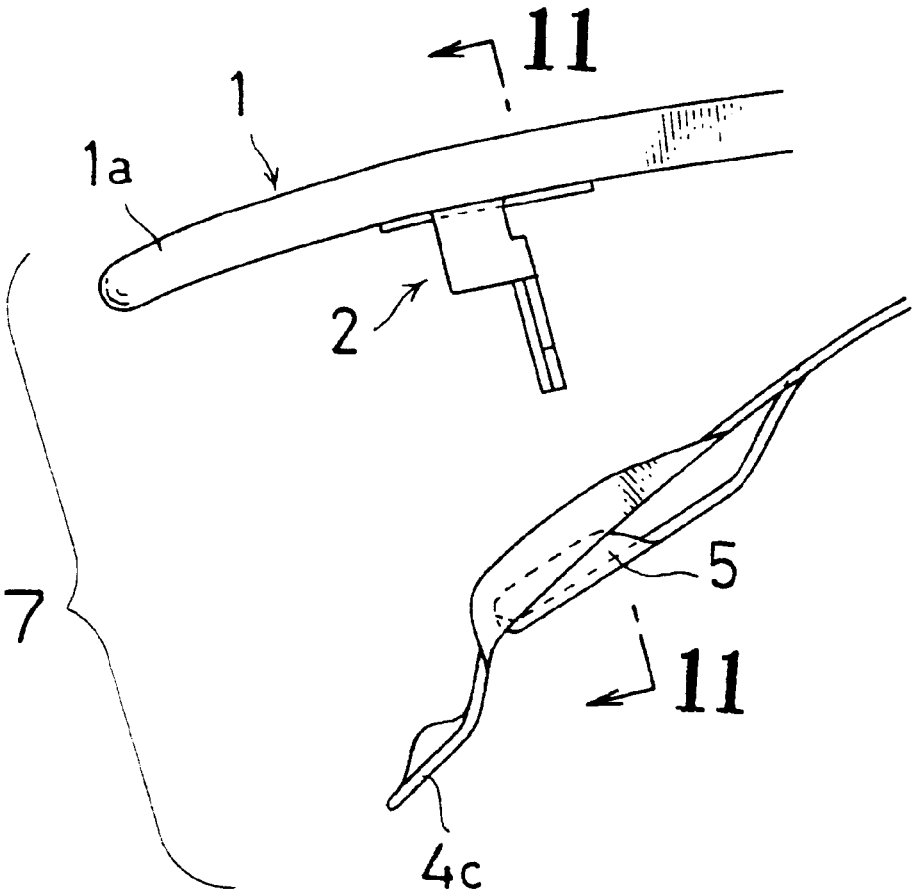
FIG. 7 is an enlarged side view around an engaging portion in the unlatched state.
Figure 11:
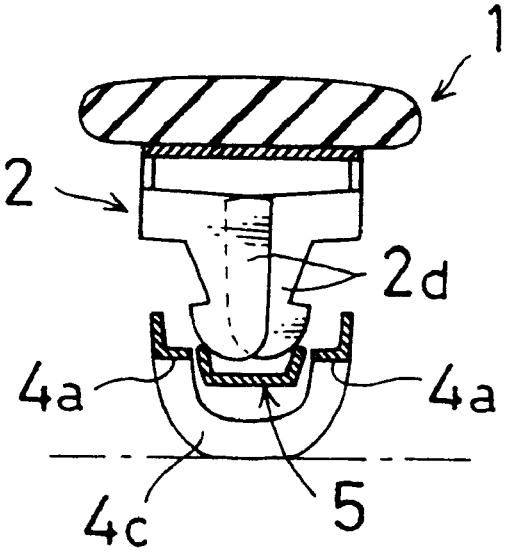
FIG. 11 is a cross-sectional view corresponding to FIGS. 8–10 and illustrates a state in which a hair retainer is rotated to open from the state shown in FIG. 10; and, FIG. 12 is a cross-sectional view corresponding to FIGS. 8–10 and illustrates a state in which the hair retainer is fully unlatched.
Figure 12:
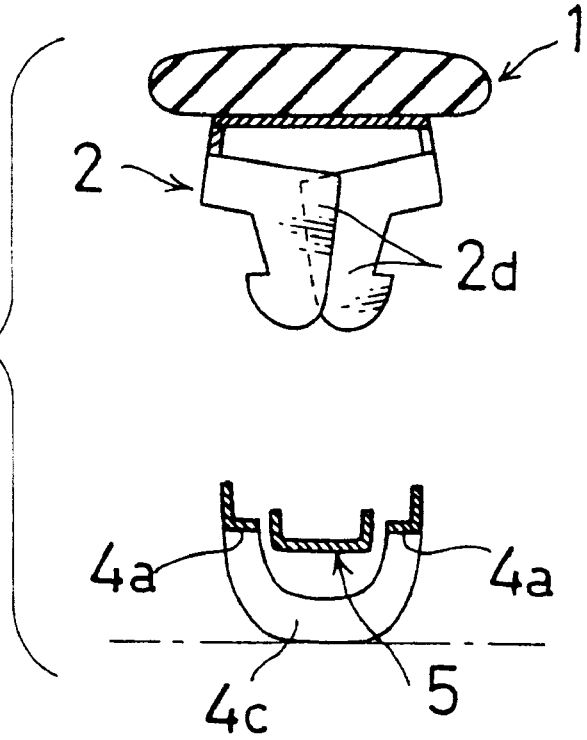

Upon removal of the pressure which has been imparted, the hair retainer 4 will rotate itself away from the ornamental cover 1 due to the resilient force thereof, whereby the hooks 2*f*, 2*f* pass through and between the engaging portions 4*a*, 4*a* with the engaging arms 2*d*, 2*d* held by the releasing member 5 as shown in FIG. 11. When the hair retainer 4 is further rotated to open as shown in FIGS. 7 and 12, the engaging arms 2*d*, 2*d* are pulled out of the releasing member 5. In this way, the unlatching operation can easily be performed.

An actuating member may also be provided at the engaging member 2 to operate the overlap of the engaging arms 2*d*, 2*d* as in the conventional hair clips.

This application claims priority to Japanese Patent Application No. Hei 9(1997)-345989 filed on Dec. 16, 1997, the disclosure of which is incorporated by reference in its entirety.

The terms and expressions which have been employed herein are used as terms of description and not of limitation, and there is no intent, in the use of such terms and expressions, of excluding any of the equivalents of the features shown and described or portions thereof, but it is recognized that various modifications are possible which fall within the scope of the invention claimed.

What is claimed is:

1. A hair clip comprising:

an ornamental cover having a pair of engaging arms at one end portion of said ornamental cover and a bracket at the other end portion of said ornamental cover, said pair of engaging arms being overlapped with each other;

a hair retainer having a first end portion pivoted to said bracket and a second end portion provided with a pair of engaging portions to be latched to said pair of engaging arms, said pair of engaging portions being spaced apart from each other; and a releaser for unlatching said pair of engaging arms from said pair of engaging portions, wherein said releaser includes a releasing member which extends from said hair retainer and is disposed between said pair of engaging portions, and wherein said releasing member is opposed to top end portions of said pair of engaging arms when said pair of engaging arms are latched to said pair of engaging portions, and draws said pair of engaging arms so as to further overlap each other when said releasing member is pressed against said pair of engaging arms, thereby unlatching said pair of engaging arms from said pair of engaging portions.

2. The hair retainer as recited by claim 1, wherein at least a portion of said releasing member that abuts a top portion of said pair of engaging arms is formed to have a substantially U-like cross-section.

3. The hair clip as defined by claim 1, wherein said hair retainer has at said second end portion an actuating end portion bent in a direction away from said ornamental cover.

4. The hair clip as defined by claim 1, wherein said hair retainer has a stopper extending sideways from said first end portion and said bracket has a shoulder formed at a top portion of said bracket, and said stopper abuts said shoulder to restrain further rotation of said hair retainer towards a closing direction in a state that said hair retainer is opened at a predetermined angle relative to said ornamental cover, thereby said hair retainer is urged to spring open owing to its resilient force in the latched state.

5. The hair clip as defined by claim 1, wherein said hair retainer has an actuating end portion bent in a direction away from said ornamental cover, and wherein said releasing member is pushed by said pair of engaging arms to be disposed downwardly from a plane which includes said actuating end portion when said pair of engaging arms are latched to said pair of engaging portion, while said releasing member is disposed upwardly from the plane when said engaging portions are unlatched from said pair of engaging arms.

6. The hair clip as defined by claim 1, wherein said pair of engaging arms and said bracket are detached from each other and are fixed to said ornamental cover separately.

* * * * *